US007513247B2

(12) United States Patent
Clauss et al.

(10) Patent No.: US 7,513,247 B2
(45) Date of Patent: Apr. 7, 2009

(54) GAS COOKING EQUIPMENT AND METHOD FOR PRODUCING GAS COOKING EQUIPMENT

(75) Inventors: Stephane Clauss, Lipsheim (FR); Martin Oberhomburg, Wetter (DE); Gildas Violain, Ottrott (FR)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/540,241

(22) PCT Filed: Jan. 13, 2004

(86) PCT No.: PCT/EP2004/000171

§ 371 (c)(1),
(2), (4) Date: Jun. 22, 2005

(87) PCT Pub. No.: WO2004/063629

PCT Pub. Date: Jul. 29, 2004

(65) Prior Publication Data

US 2006/0016444 A1 Jan. 26, 2006

(30) Foreign Application Priority Data

Jan. 13, 2003 (EP) ..... 03360005

(51) Int. Cl.
*F24C 3/00* (2006.01)

(52) U.S. Cl. ..... 126/39 E; 126/39 R; 431/12

(58) Field of Classification Search ..... 126/39 E, 126/39 R; 431/12
See application file for complete search history.

(56) References Cited

U.S. PATENT DOCUMENTS

| | | | | |
|---|---|---|---|---|
| 4,134,719 | A * | 1/1979 | Velie | 431/171 |
| 5,938,425 | A | 8/1999 | Damrath et al. | |
| 6,263,868 | B1 * | 7/2001 | Koch et al. | 126/39 R |
| 6,322,354 | B1 * | 11/2001 | Carbone et al. | 431/284 |
| 2002/0086254 | A1 | 7/2002 | Chen | |

FOREIGN PATENT DOCUMENTS

| | | | |
|---|---|---|---|
| DE | 42 25 789 | A1 | 2/1993 |
| EP | 0 949 455 | A1 | 10/1999 |

OTHER PUBLICATIONS

International Search Report for PCT/EP2004/000171.

* cited by examiner

*Primary Examiner*—Alfred Basichas
(74) *Attorney, Agent, or Firm*—Russell W. Warnock; James E. Howard

(57) ABSTRACT

A control system for adjusting the heat output of at least one gas burner. The control system including at least one control organ in a gas main line feeding the gas burner for adjusting the gas throughput supplied to the gas burner nozzle. The control system further including at least one secondary line in parallel with the control organ with a shut-off organ for opening and closing the secondary line. The secondary line having a lower flow resistance than the flow resistance in the control organ line.

20 Claims, 4 Drawing Sheets

GAS COOKING EQUIPMENT AND METHOD FOR PRODUCING GAS COOKING EQUIPMENT

The present invention relates to gas cooking equipment and a method for producing the same. The gas cooking equipment has at least one gas burner and a control system for adjusting the heat output of the gas burner. The control system further has at least one control organ in a gas main leading to the gas burner which adjusts a gas throughput supplied to a burner nozzle and at least one secondary line running parallel to the control organ with an allocated shut-off organ for opening and closing the secondary line.

A generic cooking apparatus having a valve control arrangement in a gas supply pipe to a gas burner is known from EP 0 818 655. In the valve control arrangement the gas supply pipe branches into a number of part gas pipes switched in parallel, which are connected to the burner nozzle. A control valve for switching on and off the part gas stream flowing therethrough and a choke element for throttling the part gas stream flowing therethrough are arranged in each part gas pipe. A defined reduction of the gas flow can be implemented by combining certain switching elements which have been switched on and switched off. The maximum gas flow is achieved when all the choke elements are open.

The object of the present invention is to provide gas cooking equipment or a method for producing gas cooking equipment with at least one gas burner whose control system allows reliable operation of the burner.

The present invention provides gas cooking equipment having at least one secondary line switched in parallel to a control organ with the secondary line having a flow resistance which restricts the gas throughput in the secondary line. Said flow resistance is constructed as lower than the flow resistance formed by the burner nozzle. A pressure loss in the gas flow through the secondary line is thus substantially reduced. The substantially reduced pressure loss when the secondary line is open results in an improved primary air intake in the area of the burner nozzle. The flame formation at the gas burner is therefore substantially more reliable at high gas flow rates.

The flow resistance in the secondary line can be determined in various ways. In a simple realisation of the invention from the point of view of production technology, the determining flow resistance which restricts the gas throughput is determined by the smallest transmission cross-section in the secondary line. The smallest transmission cross-section in the secondary line is thus larger than the transmission cross-section of the burner nozzle.

It is advantageous if the secondary line is only opened to adjust the maximum gas throughput during operation of cooking equipment. The secondary line is therefore not used to adjust the part gas throughputs. In this case, the flow resistance in the secondary line can be reduced to a negligible amount compared with the flow resistance in the gas main. Thus, regardless of whether the control organ arranged in the gas main is opened or closed, the maximum gas throughput is always set when the secondary line is open.

The control system can preferably have a number of control lines switched in parallel to one another with corresponding control or regulating organs. These branch off the gas main and can each supply a part gas throughput to the burner nozzle. Compared to conventional gas taps, no hysteresis effects are obtained with such a control system. The control lines switched in parallel make it possible to adjust the part gas throughput substantially more accurately. The maximum gas throughput is set when all the control lines of the control system are opened. In this case, however, the pressure loss in the control system is substantially higher than that when a conventional completely opened gas tap is used. In this control system in particular, the pressure loss at maximum gas throughput can be effectively reduced by the secondary line according to the invention.

A control valve with an associated control choke can be provided in each of the control lines as shut-off or regulating organs. The control choke is used to restrict the gas throughput to a part gas throughput. In contrast to a proportional valve with continuous adjustment, the control valve merely has one closed and one opened position.

In order to reduce the flow resistance in the secondary line, the number of inserts in the secondary line, possibly the number of shut-off, control or regulating organs, is restricted to merely one unthrottled shut-off organ.

For reasons of space it is advantageous if the control lines are brought together in a housing, for example, a valve block. The secondary line can advantageously be integrated in the housing of the control system. Assembly of the control elements or choke elements at the works is simplified if the choke elements are inserted in mounting openings of the control lines in the housing of the control system such that they can be removed.

In a particularly simple method of manufacturing the control system from the production technology point of view, a conventional valve block having a number of control lines is first manufactured. Choke elements are inserted in the control lines, with the exception of at least one control line. The unthrottled control line forms the secondary line according to the invention.

Instead of a choke element, the mounting opening of the unthrottled control line can be closed by a non-throttling closure element. Alternatively, a choke element can be mounted in the unthrottled control lines of the valve block, the transmission cross-section of said choke element being larger than the transmission cross-section of the burner nozzle. From the production technology point of view, it is especially advantageous if the mounting opening in the unthrottled control line is completely dispensed with when manufacturing the valve block.

An exemplary embodiment of the invention is described in the following with reference to the appended figures. In the figures.

Figure 1:
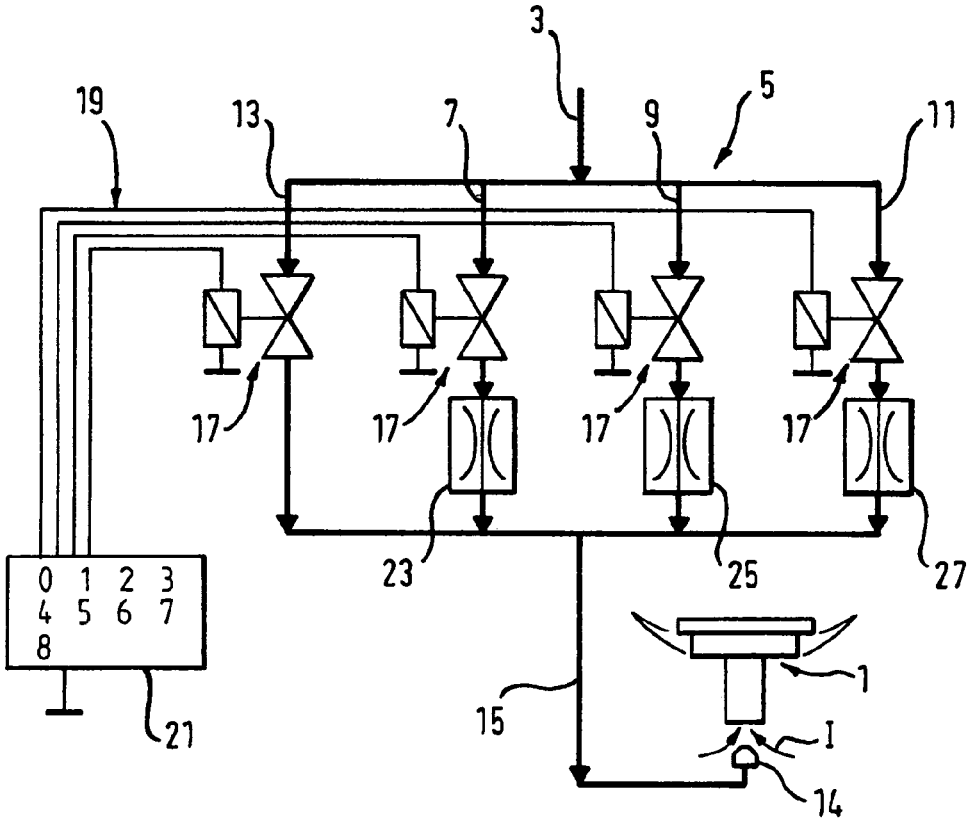
FIG. 1 is a schematic block diagram comprising a gas burner of a gas cooking apparatus and a control system.

A gas burner 1 belonging to a gas cooking apparatus is shown highly schematically in FIG. 1. Said gas burner is connected via a gas main 3 to a gas pipe network. A control system 5 is arranged in the gas main 3. A gas throughput to the gas burner 1 is adjusted by means of the control system 5 according to a desired heat output of the gas burner 1. Not shown are the usual safety elements for the gas cooking equipment such as a thermocouple and a relevant magnetic valve for shutting down the gas burner for safety when a flame goes out.

The control system 5 has three control lines 7, 9, 11 switched in parallel and a secondary line 13 switched in parallel thereto. Both the control lines 7, 9, 11 and the secondary line 13 branch off from the gas main 3 and then combine again to form a burner intake pipe 15. Said intake pipe opens into a burner nozzle 14. An electrically actuated magnetic control valve is arranged in each of these lines 7, 9, 11, 13. The magnetic control valves 17 can be switched from a closed position into an open position and can be controlled by means of an electronic control device 21 via signal leads 19. A user can adjust heat output stages of the gas burner 1 via the control device 21. As is described subsequently with reference to FIG. 2, a part gas throughput $Q_1$ to $Q_7$ Up to a maximum gas throughput $Q_8$ can be adjusted according to the selected heat output stage.

The control device 21 can control the magnetic control valves 17 independently of one another. The magnetic valves 17 arranged in the control lines 7, 9, 11 are followed by choke elements 23, 25, 27. The diameter $d_1$ of each choke element 23, 25, 27 indicated in FIG. 6 determines its transmission cross-section. The diameters $d_1$ in the control lines 7, 9, 11 are designed as substantially smaller than a transmission cross-section of the burner nozzle 14. Thus, in the present case the diameter of the burner nozzle 14 is about 0.5 mm. The choke diameter $d_1$ of the choke elements 23, 25, 27 lies between 0.1 and 0.3 mm.

Unlike the control lines 7, 9, 11, the secondary line 13 is unthrottled. As a result, the flow resistance in the unthrottled secondary line 13 is reduced as far as possible. Compared to the control lines 7, 9, 11, the pressure loss by the open secondary line 13 is negligible. When the secondary line 13 is open, the maximum gas throughput $Q_8$ is thus passed through the secondary line 13 without greater loss of pressure. In order to reduce the flow resistance, the transmission cross-section in the secondary line 13 is made substantially larger than the transmission cross-section of the burner nozzle 14.

The transmission cross-sections of the choke elements 23, 25, 27 are designed at the works. In the present case, when the control lines 7, 9, 11 are open, about 65% of the maximum gas throughput is supplied to the burner nozzle 14. In this case, the first choke element 23 transmits about 20%, the second choke element 25 transmits about 24% and the third choke element 27 transmits about 30% of the maximum gas throughput. By combining the open and closed positions of the magnetic valves 17 in the three control lines, eight (i.e., $2^3$) heat output stages with the different part gas throughputs 0 and $Q_1$ to $Q_7$ are obtained by means of the three control lines 7, 9, 11. The heat output stages can be adjusted by means of the electronic control device 21. The part gas throughputs $Q_1$ to $Q_7$ are obtained from the flow characteristic of the control system 5 shown in FIG. 2. If the user selects the eighth heat output stage, the electronic control device 21 opens the magnetic valve 17 in the secondary line 13. The maximum gas throughput $Q_8$ to the burner nozzle 14 is thereby set.

Figure 2:
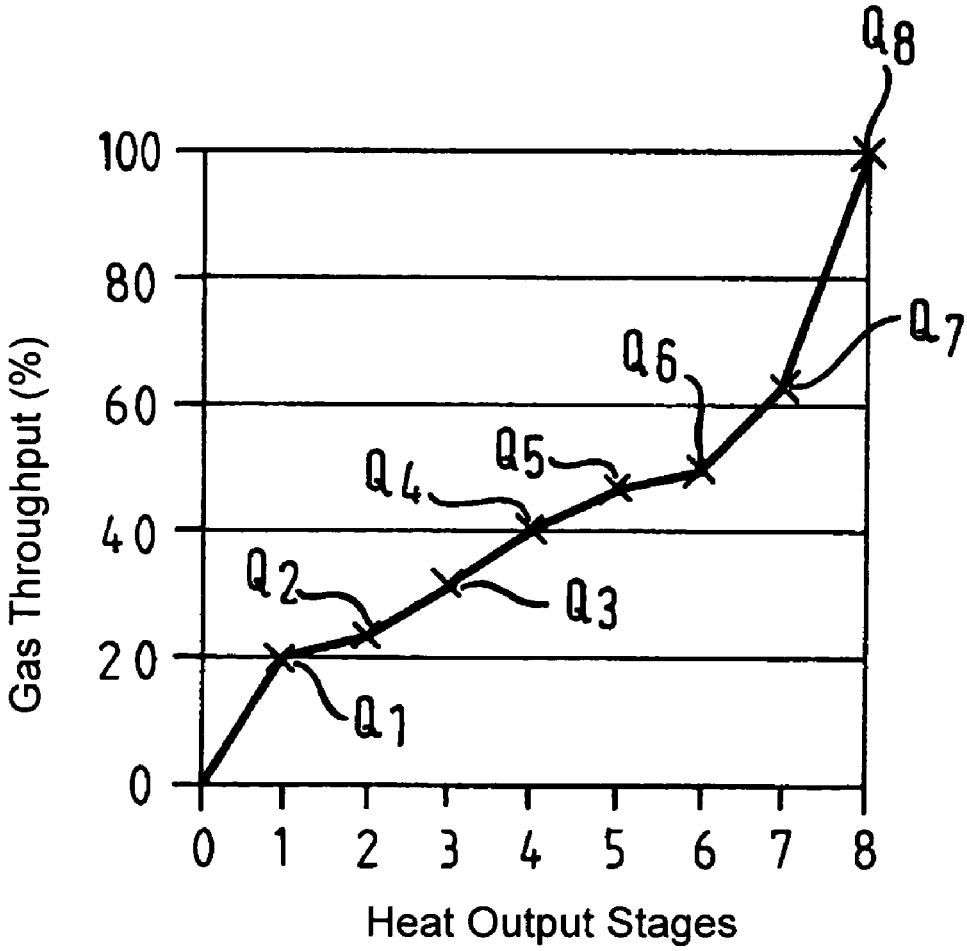
FIG. 2 shows the flow characteristic of the control system shown in FIG. 1.
Figure 3:
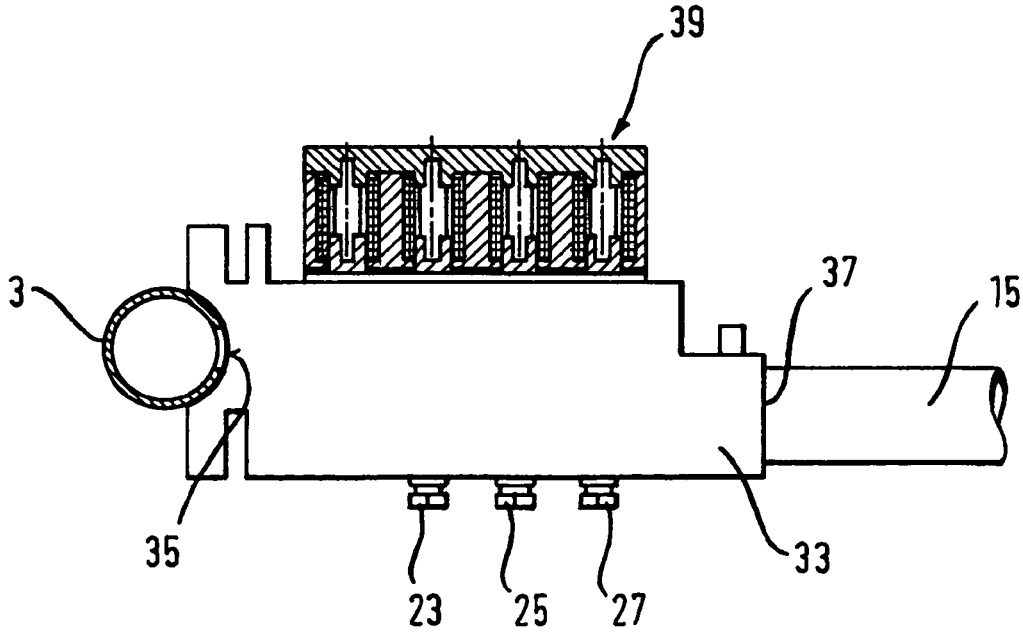
FIG. 3 is a side view of a valve block of the control system.

According to the flow characteristic in FIG. 2, the part gas throughputs $Q_1$ to $Q_7$ of the heat output stages 1 to 7 increase almost linearly up to about 62%. After the magnetic valve 17 in the secondary line 13 has been switched to the open position, an over-proportional jump of the heat output takes place from $Q_7$ to the maximum gas throughput $Q_8$. The over-proportional increase from the part gas throughput $Q_7$ to the maximum gas throughput $Q_8$ yields approximately an exponential profile of the flow characteristic. Such an exponential profile is especially advantageous from the application technology point of view.

The design configuration of the control system 5 is explained in the following FIGS. 3 to 6. Consequently, both the control lines 7, 9, 11 and also the secondary line 13 are integrated in a housing 33 formed as a compact valve block. The valve block 33 made of plastic has a hemispherical inlet connection 35 on one side when viewed from the side. Said valve block sits in positive contact on an outer circumference of the gas main 3 constructed as a pipe. The gas main 3 is pressed in a gastight fashion onto the inlet connection 35 by means of retaining clips which are not shown. An outlet connection 37 is constructed on the valve block 33 opposite to the inlet connection 35. The burner intake pipe 15 is inserted in a gastight fashion in the outlet connection 37. Four magnetic valve heads 39 of the magnetic valves 17 are further mounted in the valve block 33 according to FIG. 3. The choke elements 23, 25, 27 are shown inserted in the valve block on the opposite side.

Figure 4:
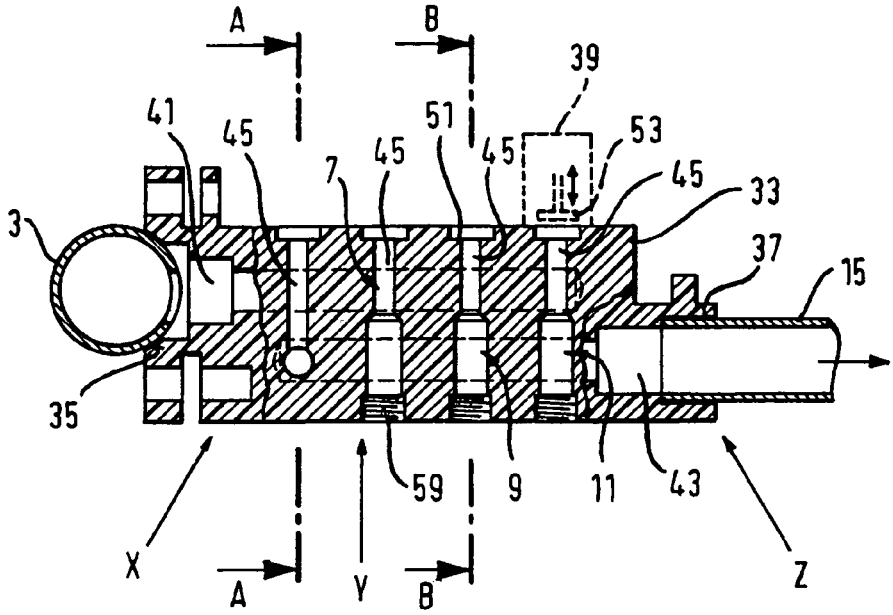
FIG. 4 is a side sectional view of the valve block of the control system.

FIG. 4 shows a side sectional view of the valve block 33. The area of the inlet connection 35, 37 is shown in a first sectional plane X. The central area of the valve block 33 between the inlet and outlet connection 35, 37 is shown parallel thereto in a second sectional plane Y. The area of the outlet connection 37 is shown in a third sectional plane Z. It can be deduced from FIG. 4 that horizontal blind holes 41, 43 oppositely directed to one another run in the valve block 33. Said holes each open into the inlet connection 35 and into the outlet connection 37 of the valve block 33 and are aligned parallel to one another. The control lines 7, 9, 11 connect the blind inlet hole 41 to the blind outlet hole 43.

Figure 5:
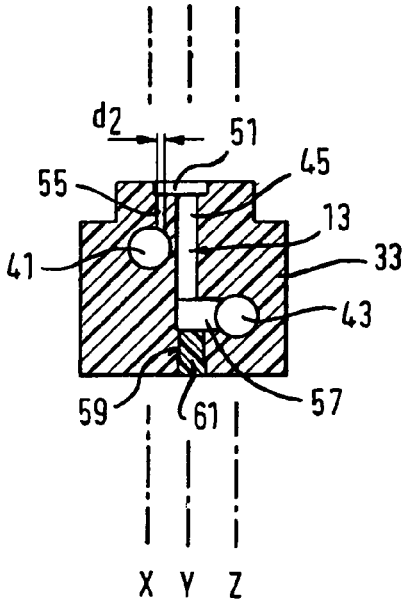
FIG. 5 is a sectional view along the line A-A from FIG. 4.
Figure 6:
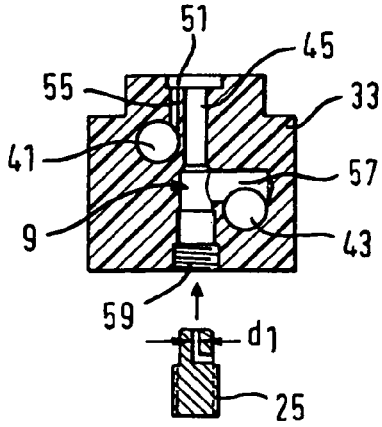
FIG. 6 is a sectional view along the line B-B from FIG. 4.

In detail each of the control lines 7, 9, 11 has a valve channel 45. The valve channel 45 runs perpendicular to the horizontal blind holes 41, 43. One end of the valve channel 45 opens into a circular recess 51 which is worked into the valve block 33. The circular recess 51 forms a valve seat for a valve disk 53 of the magnetic valve head 39, as indicated by the dashed lines in FIG. 4. In addition, a small-diameter first transmission channel 55, which leads to the blind inlet hole 41, opens into the recessed valve seat 51 as shown in FIGS. 5 and 6. At the same time, the valve channel 45 is in communication with the blind outlet hole 43 by means of a second transmission channel 57. Each of the control lines 7, 9, 11 running between the blind holes 41, 43 is consequently formed by the first transmission channel 55, the valve channel 45 and the second transmission channel 57.

In the closed position of the magnetic valves 17 the valve disk 53 of the magnetic valve heads 39 lies on the recessed valve seat 51. The valve channel 45 of the corresponding control line is thereby closed whereby the control line as such is closed. In the open position of the magnetic valve 17 the valve disk 55 is not in contact with the valve seat 51. In this case, the corresponding control line is open.

Opposite to the recessed valve seat 51 each of the valve channels 45 opens into a mounting opening 59. The choke elements 23, 25, 27 can be mounted in the mounting opening 59, as is indicated in FIG. 6. According to FIG. 6, the choke element 25 is constructed as an insert nozzle. Said nozzle can be screwed into the mounting opening 59 of the valve channel 45.

The configuration of the secondary line 13 in the valve block 33 is explained with reference to FIG. 5. Like the control lines 7, 9, 11 the secondary line 13 runs inside the valve block 33. The secondary line 13 is formed in accordance with the control lines by the first transmission channel 55, the valve channel 45 and the second transmission channel 57. Unlike the control lines, however, the secondary line 13 is unthrottled, i.e., no insert nozzle 25 is arranged in the secondary line 13. The largest possible transmission cross-section in the secondary line 13 is thereby achieved. In the secondary line the flow resistance which restricts the gas throughput is formed by the first transmission channel 55. The diameter $d_2$ of the transmission channel 55 is about 1.5 to 2 mm. The diameter $d_2$ of the first transmission channel 55 is thus considerably larger than the diameter of the burner nozzle 14.

Instead of an insert nozzle, a closure element 61 is inserted in the mounting opening 59 of the secondary line 13 according to FIG. 5. This closes the mounting opening 59 without throttling the secondary line 13. Alternatively thereto, the closure element 61 can be omitted if the mounting opening is completely dispensed with in the secondary line 13 when the valve block 33 is manufactured at the works. In this case, the secondary line 13 is closed in the area of the mounting openings 59 in the valve block 33 without the secondary line 13 being throttled.

With the present control system it is also possible to achieve small continuous heat outputs at the gas burner 1 by cyclically switching on and off the magnetic valves 17 of the control lines 7, 9, 11. It is advantageous that re-ignition can take place reliably at any pre-set heat output with the control system 5.

FIG. 2

Gas throughput (%)

Heat output stages

The invention claimed is:

1. A gas cooking apparatus, comprising:

at least one gas burner;

a control system for adjusting the heat output of said gas burner;

said control system including at least one control organ arranged in a gas main leading to said gas burner;

said control system controls said control organ to adjust a gas throughput supplied to a burner nozzle of said gas burner;

at least one primary line communicated with the gas main and coupled to said burner nozzle via said control organ such that said control organ controls the gas throughput supplied through said primary line to said burner nozzle and a path of gas supplied through said primary line via said control organ to said burner nozzle having a flow resistance greater than a flow resistance formed by said burner nozzle;

at least one secondary line coupled to said burner nozzle in parallel to said control organ;

said secondary line including an allocated shut-off organ for opening and closing said secondary line; and said secondary line formed to have a flow resistance which restricts the gas throughput in said secondary line, said flow resistance lower than a flow resistance formed by said burner nozzle.

2. The gas cooking apparatus according to claim 1, including said secondary line flow resistance which restricts said gas throughput is formed by the smallest transmission cross-section in said secondary line and said primary line flow resistance which restricts said gas throughput is formed by the smallest transmission cross-section in said primary line.

3. The gas cooking apparatus according to claim 2, including said smallest transmission cross-section in said secondary line is larger than the transmission cross-section of said burner nozzle.

4. The gas cooking apparatus according to claim 2, including said secondary line is open at least when a maximum gas throughput is set.

5. The gas cooking apparatus according to claim 4, including said secondary line is closed when a partial gas throughput is set and said secondary line is only open when said maximum gas throughput is set.

6. The gas cooking apparatus according to claim 1, including said shut-off organ for opening and closing said secondary line is constructed as an unthrottled control valve and said primary line including an allocated shut-off organ for opening and closing said primary line.

7. The gas cooking apparatus according to claim 6, including said control system including a plurality of control organs, said control organs provided in a plurality of separate control lines branching off from said gas main and said control organs switched in parallel to one another.

8. The gas cooking apparatus according to claim 1, including said control system including a plurality of control organs, said control organs provided in a plurality of separate control lines branching off from said gas main and said control organs switched in parallel to one another.

9. The gas cooking apparatus according to claim 8, including said control lines and said secondary line are constructed in a common housing.

10. The gas cooking apparatus according to claim 8, including said control and said secondary lines each have a mounting opening in said common housing for inserting said control organs.

11. The gas cooking apparatus according to claim 8, including said mounting opening of said secondary line is closed by a closure element.

12. The gas cooking apparatus according to claim 8, including said control system is designed so that a plurality of part gas throughputs ($Q_1$ to $Q_7$) increase up to about sixty percent (60%) of a maximum gas throughput ($Q_8$) in a substantially constant first increase.

13. The gas cooking apparatus according to claim 12, including in a second increase said part gas throughputs ($Q_1$ to $Q_7$) increase from about sixty percent (60%) of said maximum gas throughput ($Q_8$) to said maximum gas throughput ($Q_8$) which is greater than said first increase.

14. The gas cooking apparatus according to claim 8, including when a maximum gas throughput ($Q_8$) is set, said gas main, especially said control lines branching off from said gas main, are open.

15. A gas cooking apparatus, comprising:

at least one gas burner;

a control system for adjusting the heat output of said gas burner;

said control system including at least one control organ arranged in a gas main leading to said gas burner;

said control system controls said control organ to adjust a gas throughput supplied to a burner nozzle of said gas burner;

at least two primary lines communicated with the gas main and coupled to said burner nozzle via said control organ such that said control organ controls the gas throughput supplied through each of said primary lines to said burner nozzle, each of said primary lines forming a path of gas and the path of gas supplied through each one of said primary lines via said control organ to said burner nozzle having a flow resistance greater than a flow resistance formed by said burner nozzle;

at least one secondary line coupled to said burner nozzle in parallel to said control organ;

said secondary line including an allocated shut-off organ for opening and closing said secondary line; and said secondary line formed to have a flow resistance which restricts the gas throughput in said secondary line, said flow resistance of said secondary line being lower than a flow resistance formed by said burner nozzle, said control system controlling said control organ to adjust a gas throughput supplied to said burner nozzle supplying gas to a burner nozzle of a gas burner via said at least two primary lines, whereupon the respective gas supplied through each respective primary line communicated with said burner nozzle is less than a maximum gas throughput that could be handled by said burner nozzle and controlling gas supplied via said at least two primary lines such that the collective gas throughput through all primary lines is less than the maximum gas throughput that could be handled by said burner nozzle and said control system selectively supplying gas to said burner nozzle via said secondary line at a time during which said supplying gas via said at least two primary lines occurs, whereupon the total gas supplied to said burner nozzle during such simultaneous supplying of gas via said at least two primary lines and via said secondary line is at least equal to the maximum gas throughput that could be handled by said burner nozzle.

16. A method for controlling a gas cooking apparatus including at least one gas burner, the method comprising:

supplying gas to a burner nozzle of a gas burner via a primary gas route, said supplying gas via a primary gas route including supplying gas through at least one primary line communicated with said burner nozzle and having a flow resistance greater than a flow resistance formed by said burner nozzle, whereupon the respective gas supplied through each respective primary line communicated with said burner nozzle is less than a maximum gas throughput that could be handled by said burner nozzle and controlling gas supplied via said primary gas route such that the collective gas throughput through all primary lines is less than the maximum gas throughput that could be handled by said burner nozzle; and selectively supplying gas to said burner nozzle via a secondary gas route, said selectively supplying gas via said secondary gas route including supplying gas through a secondary line having a flow resistance lower than a flow resistance formed by said burner nozzle and supplying gas through said secondary line at a time during which said supplying gas via said primary gas route occurs, whereupon the total gas supplied to said burner nozzle during such simultaneous supplying of gas via said primary gas route and via said secondary gas route is at least equal to the maximum gas throughput that could be handled by said burner nozzle.

17. The method according to claim 16, including closing said secondary line when a partial gas throughput is set and only opening said secondary when said maximum gas throughput is set.

18. The method according to claim 16, including forming said shut-off organ for opening and closing said secondary line as an unthrottled control valve.

19. The method according to claim 16, wherein said selectively supplying gas via said secondary gas route includes supplying gas through a secondary line which restricts said gas throughput by the smallest transmission cross-section among said primary line and said secondary line.

20. The method according to claim 16, wherein said selectively supplying gas via said secondary gas route includes supplying gas through a secondary line whose cross-section is the smallest transmission cross-section among said primary line and said secondary line and this transmission cross-section in said secondary line is larger than the transmission cross-section of said burner nozzle.

* * * * *